United States Patent [19]

Phillips

[11] 3,960,184

[45] June 1, 1976

[54] LOOM PICKER RETAINER

[75] Inventor: Eugene N. Phillips, Hopedale, Mass.

[73] Assignee: Rockwell International Corporation, Pittsburgh, Pa.

[22] Filed: Apr. 28, 1975

[21] Appl. No.: 572,060

[52] U.S. Cl. ..... 139/159

[51] Int. Cl.[2] ..... D03D 49/36

[58] Field of Search ..... 139/159, 160 A, 160 R, 139/157

[56] References Cited

UNITED STATES PATENTS

| | | | |
|---|---|---|---|
| 1,354,072 | 9/1920 | Savoie | 139/159 |
| 1,584,872 | 5/1926 | La Plante | 139/159 |
| 3,527,259 | 9/1970 | Picanol | 139/159 |

FOREIGN PATENTS OR APPLICATIONS

| | | | |
|---|---|---|---|
| 776,242 | 10/1934 | France | 139/159 |
| 1,135,040 | 12/1956 | France | 139/159 |

*Primary Examiner*—James Kee Chi

[57] ABSTRACT

An improved device for maintaining a picker in a predetermined location on a loom picker stick, which permits worn pickers to be quickly and easily removed and replaced with a new picker and in the same operating position as the replaced picker without the normally required adjustments for alignment with a loom's shuttle.

1 Claim, 3 Drawing Figures

LOOM PICKER RETAINER

BACKGROUND OF THE INVENTION

1. Field of the Invention

The invention relates to looms of the fly-shuttle type in which a weft carrying shuttle is picked back and forth across the width of a loom by a picking apparatus located at each side of the loom and which are disposed in opposed relation. In particular the invention pertains to an improved device for positioning and retaining loop-type pickers on a loom's picker stick.

2. Description of the Prior Art

Looms of the type having a picker attached adjacent one end of a picker stick are usually fixed to the latter by means of a screw passing through a part of the picker and into the picker stick. This type of picker is commonly referred to as a "loop picker" and includes a conically formed recess disposed for engagement with the spur of a shuttle and a loop portion which provides the means for being received onto the end of a picker stick. The end of the picker stick on which the picker assembles is slightly tapered and the loop of said picker is driven onto the taper to a position of alignment with the shuttle spur and is then locked in this position by means of a screw. The picker stick must be drilled for the reception of the screw which in some case splits the end of the stick. These screws have frequently been known to become loose to the extent of dropping out which allows the picker to shift out of alignment with the shuttle, and even come off the stick entirely. After replacing pickers a number of times, the screw is no longer capable of holding in the picker stick which makes a more satisfactory retaining means something to be desired. In an effort to provide a more satisfactory picker retaining means there have been many suggestions and such means as adhesives, clamps, wedges, special locking screws and the like have been subject matter of several patents, however, the loop picker is still almost universally held in place by a wood screw threaded into the picker stick. Although many of the suggestions for retaining a picker on a picker stick have worked satisfactorily in so far as holding the picker in its proper operating position, they have not provided a simplified means for its replacement or which is not responsible for damage to the stick itself. A picker which is held in place by an adhesive and certain types of wedges ususally have to be cut-off, to make a replacement, and has been known to result in damaging effects to the picker stick. Also the use of clamps and locking screws has resulted in such damage as crushing and splitting of the picker stick in the area where the picker assembles.

The loom picker retainer according to the present invention has eliminated the problems associated with picker retainers of the prior art and provides a device which permits a worn picker to be quickly and easily replaced without damaging the picker stick. Additionally the device will automatically locate a new picker in the same operating positon in which the picker it replaces was located thereby eliminating the normally required adjustment to align a new picker with the spur of a shuttle.

SUMMARY OF THE INVENTION

The improved loom picker retainer of the present invention includes a pair of plate-like retaining members which in assembled position are interposed between the inner side walls of the loop portion of the picker and the adjoining surfaces of the picker stick. Each of the plate-like retaining members includes a portion which extends downwardly beyond the lowermost portion of the picker and are provided in this area with apertures which align with a drilled hole in the picker stick. A pin member assembles in the hole in the picker stick with each end thereof being seated in the apertures provided in the plate-like retaining members. This pin member locates the plate-like retaining members at a predetermined position on the picker stick and by means of integrally formed and laterally extending lips formed on the upper end of each said retaining members the vertical location of the picker on the picker stick is determined. It is a general object of the invention to provide a simple, effective and inexpensive device for maintaining a picker in operating position on the picker stick of a loom.

A further object is to provide a picker retainer which cannot damage a picker stick and which enables a worn picker to be quickly and easily replaced.

A further object is to provide a picker retainer which will automatically align a replacement picker with the spur of a loom shuttle.

These and other objects of the invention will become more fully apparent by reference to the appended claims and as the following detailed description proceeds in reference to the figures of drawing wherein:

DESCRIPTION OF THE PREFERRED EMBODIMENT

Figure 1:
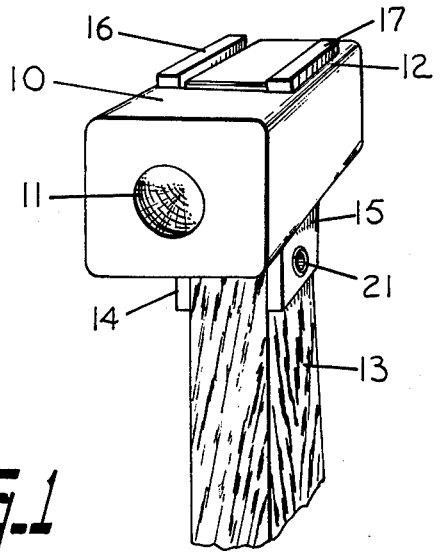
FIG. 1 is a perspective view of the upper end of a picker stick showing a picker and the picker retainer according to the invention assembled thereto.

Now referring to FIG. 1 a picker of the type known as a "loop picker" has a body portion 10 with a conical indentation 11 for reception of the spur of a shuttle and a loop portion 12 which fits about the upper tapered end of a picker stick 13.

Figure 2:
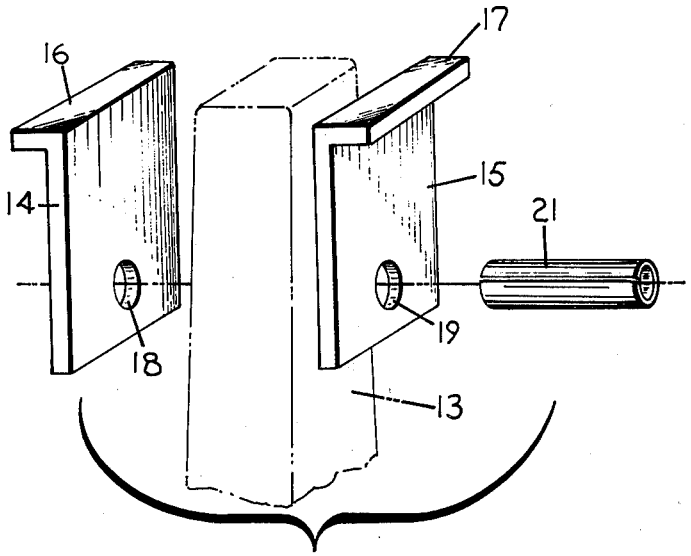
FIG. 2 is a perspective view in exploded form showing further detail of the picker retainer.
Figure 3:
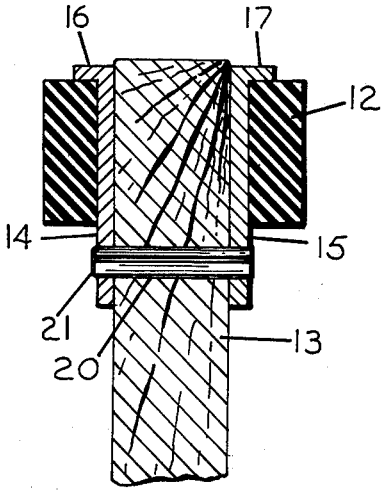
FIG. 3 is a sectional view showing the pin member in assembled position which locks the plate-like retaining members at a preselected location on the picker stick.

Interposed between the inner side walls of the loop portion 12 of the picker and the adjoining surfaces of the picker stick 13 a pair of plate-like retaining members 14 and 15 are provided. These retaining members 14 and 15 include laterally intending lips 16 and 17 respectively integrally formed on the upper ends thereof and as shown in FIGS. 1 and 3 are adapted to engage the upper surface of the loop portion 12 of the picker. The retaining members 14 and 15 extend downwardly beyond the lower surface of the picker and are provided adjacent their lower ends with apertures 18 and 19 respectively (FIG. 2).

As shown in FIG. 3, a drilled hole 20 is provided in the picker stick at a predetermined distance below its upper end and by means of a pin 21 the plate-like retaining members 14 and 15 are located on the picker stick in a position which defines the vertical location of the picker on said picker stick.

To summarize the procedure for replacing a picker on a picker stick, one simply removes the pin 21 that is preferably of the roll type and then lifts the picker with the plate-like retaining members from the picker stick.

The retaining members are then inserted into the loop portion of a new picker and the three elements are then pushed downwardly over the top of the picker stick until the apertures 18 and 19 in the plate-like retaining members 14 and 15 come into alignment with the hole 20 in the picker stick. The pin 21 is then inserted to maintain the picker in the operating position. This means of retaining a picker and replacing a worn picker automatically aligns the conical indentation 11 with the spur of the shuttle and the picker's natural tendency to rise on the picker stick during loom operation is prevented by the lips 16 and 17 of the retaining members.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. In combination with a picker stick of a loom and a loop picker carried thereon having a substantially rectangular opening defined by inner side walls and end walls of comparably shorter length than the inner side walls to receive the end of the picker stick, a picker retaining device comprising:

a. a plate-like retaining member interposed between each of the inner side walls of the picker and the adjoining surface of the picker stick, said plate-like retaining members including a portion which extends downwardly beyond the lowermost portion of the picker;

b. a laterally extending lip integrally formed on the upper end of each said plate-like retaining member and extending therefrom into engagement with the picker defining a vertical location of the picker on the picker stick; and c. a pin member extending through the picker stick below the picker with the ends thereof connected to said plate-like retaining member for locking the latter at a preselected location on the picker stick so that the location of the picker cannot change during loom operation.

* * * * *